US006009718A

United States Patent [19]

Ikari et al.

[11] Patent Number: 6,009,718

[45] Date of Patent: Jan. 4, 2000

[54] ICE DISPENSER FOR PRODUCING CHIP ICE TO DELIVER THE SAME TO USER

[75] Inventors: Hideyuki Ikari; Hiroshi Ueno, both of Aichi-ken, Japan

[73] Assignee: Hoshizaki Denki Kabushiki Kaisha, Toyoake, Japan

[21] Appl. No.: 09/121,867

[22] Filed: Jul. 24, 1998

[30] Foreign Application Priority Data

Jul. 25, 1997 [JP] Japan ..... 9-200321

[51] Int. Cl.[7] ..... F25C 1/14

[52] U.S. Cl. ..... 62/354; 222/129.1; 251/129.2; 251/228

[58] Field of Search ..... 62/354; 222/129, 222/129.1, 146.6; 251/129.2, 228

[56] References Cited

U.S. PATENT DOCUMENTS

| | | | |
|---|---|---|---|
| 3,667,724 | 6/1972 | Cornelius | 251/129.2 |
| 3,804,124 | 4/1974 | Finke et al. | 251/228 |
| 4,771,609 | 9/1988 | Funabashi | 62/354 |
| 5,279,445 | 1/1994 | Fisher et al. | 222/146.6 |
| 5,444,200 | 8/1995 | Ikari | 200/61.2 |
| 5,531,079 | 7/1996 | Tatematsu et al. | 62/354 |

FOREIGN PATENT DOCUMENTS 04187961 7/1992 European Pat. Off. .

4-4676 1/1992 Japan .

*Primary Examiner*—William E. Tapolcai

*Attorney, Agent, or Firm*—Wenderoth, Lind & Ponack, L.L.P.

[57] ABSTRACT

An ice dispenser comprises an ice making device including an auger that rotates around a substantially vertical axis; a chip ice stocker having a cylindrical wall formed around an agitator that is attached to an upper end portion of the auger, and an opening formed on the cylindrical wall; and an opening open/closure device including a shutter pivotably joined to a bracket that is attached to the cylindrical wall via a connecting shaft, a plunger that is actuated at right angle to the connecting shaft by the electromagnetic action of a solenoid fixed on the bracket, and a link for joining the shutter and the plunger, a supporting pivot attached to the link parallel to the connecting shaft, a shutter lock arm pivotably supported around the supporting pivot and having a hollow portion shaped so as to engage an outer peripheral surface of the connecting shaft, and shutter lock spring means for locking the shutter by applying spring force to the shutter lock arm pivoted around the supporting pivot thereby pressing the hollow portion on the outer peripheral surface of the connecting shaft. The connecting shaft is provided with a sleeve formed from material which is softer than the shutter lock arm, and having an outer periphery surface which engages to the hollow portion.

13 Claims, 7 Drawing Sheets

ICE DISPENSER FOR PRODUCING CHIP ICE TO DELIVER THE SAME TO USER

BACKGROUND OF THE INVENTION

1. Field of the Invention

The present invention relates to an ice dispenser for producing chip ice to deliver the same to user.

2. Description of the Related Art

An ice dispenser is disclosed in Japanese Patent Application Laid-Open No. Hei. 4-187961 is known as a machine for producing chip ice for delivery to a user. The ice dispenser is provided with an ice-making device including an auger that rotates spirally around a substantially vertical axis, and an agitator mounted on an upper end portion of the auger. The aforementioned ice dispenser is further provided with a chip ice stocker for storing chip ice produced in the ice-making device. The chip ice stocker includes a cylindrical wall formed around the agitator, and an opening formed on the cylindrical wall.

The opening formed on the cylindrical wall is opened and closed by an opening open/closure device. The opening open/closure device includes a bracket attached to the cylindrical wall, a shutter pivotably joined to the bracket via a connecting shaft, shutter springs for energizing the shutter around the connecting shaft so that the shutter closes the opening, a solenoid fixed on the bracket, a plunger that is actuated at right angle to the connecting shaft by the electromagnetic action of the solenoid, and a link for joining the shutter and the plunger.

In such an ice dispenser, since the chip ice that has been stored in the chip ice stocker is agitated by the agitator, it is possible to discharge the chip ice from the opening that is formed on the cylindrical wall of the chip ice stocker, even if the amount of ice stored in the chip ice stocker is low. When the chip ice stocker is almost filled with the stored ice, however, the shutter is rotatively moved by the agitating force being applied to the agitator in such a direction that the shutter be apart from the opening. Therefore, there is a risk that the chip ice can be freely discharged from the opening of the chip ice stocker.

In order to overcome such inconvenience, Japanese Utility Model Application Laid-Open No. Hei. 4-4676 discloses an opening open/closure device which further includes a supporting pivot attached to the link parallel to the connecting shaft, a shutter lock arm pivotably supported around the supporting pivot and having a hollow portion shaped so as to engage an outer peripheral surface of the connecting shaft, and shutter lock spring means for locking the shutter by applying spring force to the shutter lock arm pivoted around the supporting pivot thereby pressing the hollow portion on the outer peripheral surface of the connecting shaft.

While the shutter is locked by the shutter lock arm, however, since the hollow portion is forcibly pressed against the outer peripheral surface of the connecting shaft, the hollow portion becomes increasingly worn down. If the degree of the wear of the hollow portion increases, though the solenoid is actuated, the hollow portion is held in a state of being hollowed over the connecting shaft, and then the opening of the chip ice stocker cannot be opened. As a result, there is a disadvantage that the chip ice may not be delivered to a user when the user desires.

SUMMARY OF THE INVENTION

In order to overcome such problems as set forth above, an object of the present invention therefore is to provide an ice dispenser capable of securely delivering chip ice to a user when the user desires by deteriorating the wear of the hollow portion that is formed on a shutter lock arm.

According to the present invention, there is provided an ice dispenser comprising: an ice making device including an auger that rotates around a substantially vertical axis, and an agitator attached to an upper end portion of the auger; a chip ice stocker having a cylindrical wall formed around the agitator and an opening formed on the cylindrical wall; and an opening open/closure device including a bracket attached to the cylindrical wall, a shutter pivotably joined to the bracket via a connecting shaft, shutter springs for energizing the shutter around the connecting shaft so that the shutter closes the opening, a solenoid fixed on the bracket, a plunger that is actuated at right angle to the connecting shaft by the electromagnetic action of the solenoid, a link for joining the shutter and the plunger, a supporting pivot attached to the link parallel to the connecting shaft, a shutter lock arm pivotably supported around the supporting pivot and having a hollow portion shaped so as to engage an outer peripheral surface of the connecting shaft, and shutter lock spring means for locking the shutter by applying spring force to the shutter lock arm pivoted around the supporting pivot thereby pressing the hollow portion on the outer peripheral surface of the connecting shaft; wherein the connecting shaft is provided with a sleeve formed from material which is softer than the shutter lock arm, and having an outer periphery surface which engages to the hollow portion.

According to one aspect of the present invention, the shutter lock arm is formed from a metallic material. According to another aspect of the present invention, the shutter lock arm has a surface that is subjected to tufftriding treatment.

According to still another aspect of the present invention, the sleeve is positioned at a center portion of the connecting shaft along the longitudinal direction of the connecting shaft. According to aspect of the present invention, the connecting shaft includes a first axis portion having substantially the same outside diameter as that of the sleeve, and a second axis portion formed at one end of the first axis portion. According to aspect of the present invention, the sleeve is sandwiched between the first axis portion and a pipe fitted around the outer periphery of the second axis portion.

According to a further aspect of the present invention, the sleeve is formed from fluorine resin. According to a still further aspect of the present invention, there is provided an ice dispenser comprising: an ice making device including an auger that rotates around a substantially vertical axis, and an agitator attached to an upper end portion of the auger; a chip ice stocker for storing chip ice made by the ice making device, having a cylindrical wall formed around the agitator and an opening formed on the cylindrical wall; and an opening open/closure device including a bracket attached to the cylindrical wall, a shutter pivotably joined to the bracket via a connecting shaft, shutter springs for energizing the shutter around the connecting shaft so that the shutter closes the opening, a solenoid fixed on the bracket, a plunger that is actuated at right angle to the connecting shaft by the electromagnetic action of the solenoid, a link for joining the shutter and the plunger, a supporting pivot attached to the link parallel to the connecting shaft, a shutter lock arm pivotably supported around the supporting pivot and having a hollow portion shaped so as to engage an outer peripheral surface of the connecting shaft, and shutter lock spring means for locking the shutter by applying spring force to the shutter lock arm pivoted around the supporting pivot thereby pressing the hollow portion on the outer peripheral surface of the connecting shaft; wherein the shutter lock arm is formed from material which is harder than the connecting shaft.

BRIEF DESCRIPTION OF THE DRAWINGS

Other objects and advantages of the present invention will be apparent during the following discussion of the accompanying drawings, wherein.

DESCRIPTION OF THE PREFERRED EMBODIMENTS

Figure 1:
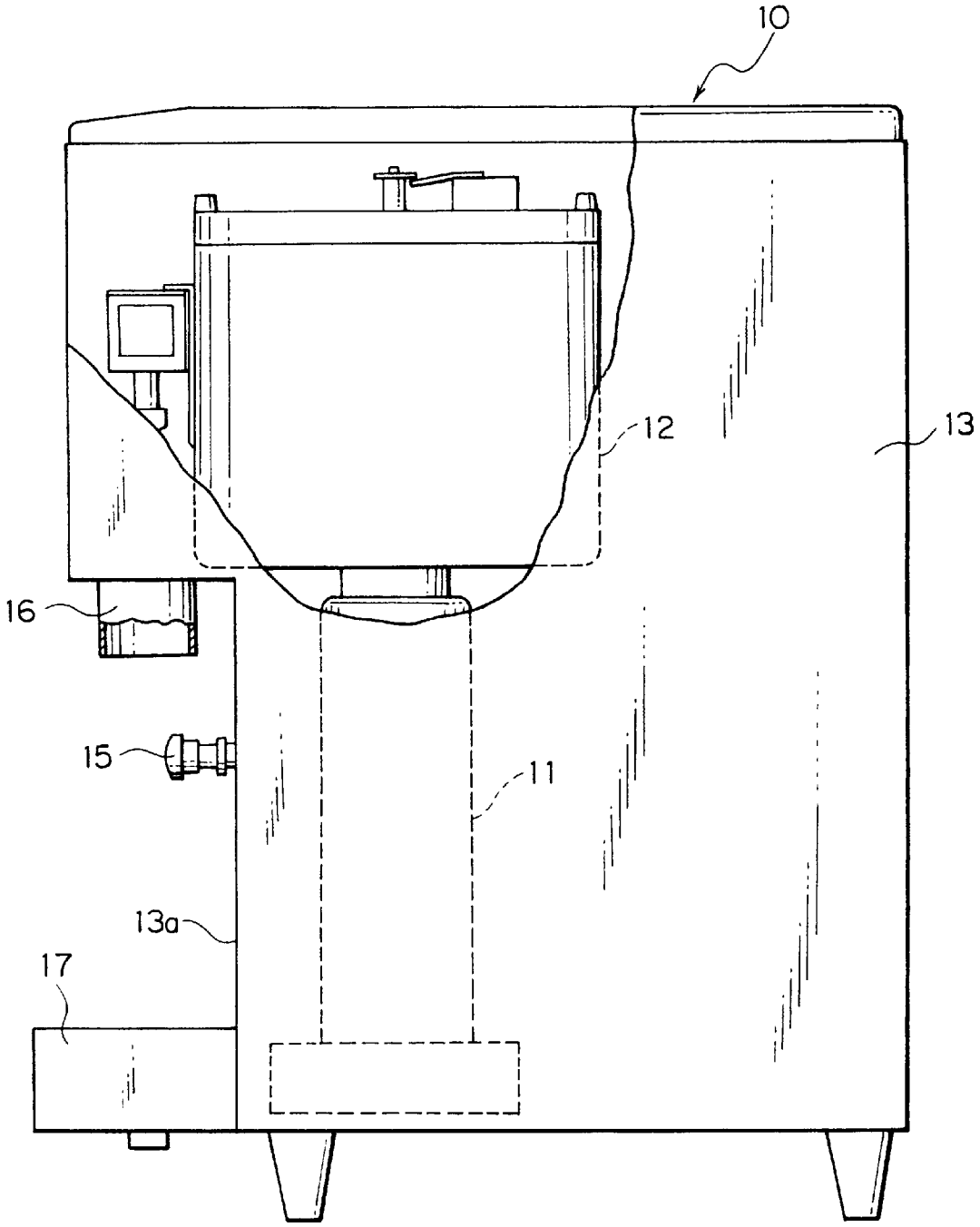
FIG. 1 is a side view showing an ice dispenser as set forth in a first embodiment of the present invention.

FIG. 1 will now be described. FIG. 1 illustrates an ice dispenser 10 in accordance with a first embodiment of the present invention, which comprises an ice making device 11 for producing chip ice, and a chip ice stocker 12 for storing the chip ice produced in the ice making device 11. The ice making device 11 is received in a cabinet 13 with the chip ice stocker 12. The cabinet 13 has an apron panel 13*a* facing to the front face of the device 11, a drain pan 17 attached to a lower portion of the apron panel 13*a*, an ice chute 16 for discharging the chip ice to the upper surface of the drain pan 17, and a discharge switch 15 for discharging the chip ice from the chute 16.

Figure 2:
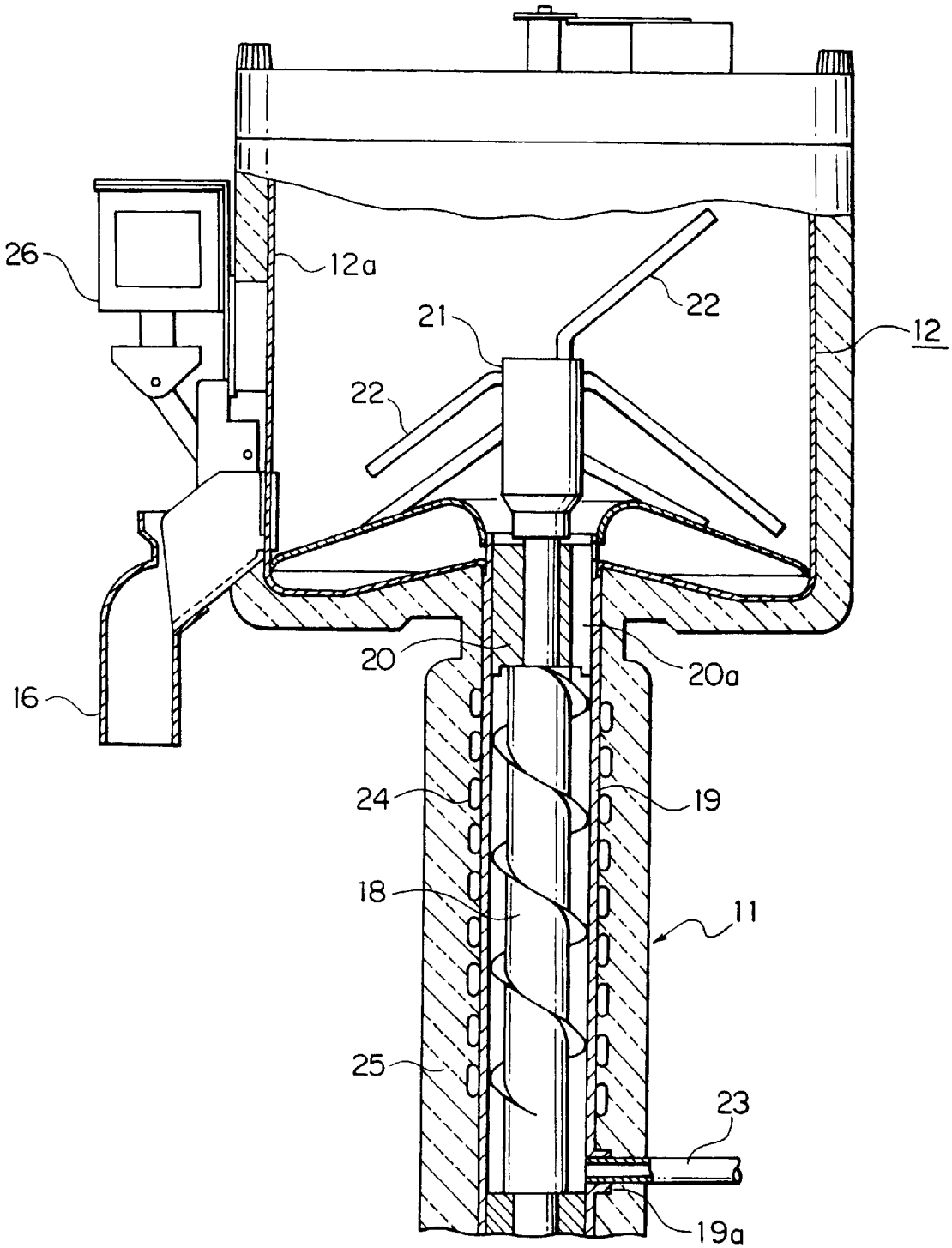
FIG. 2 is a diagram showing a structure of an ice making device and a chip ice stocker as shown in FIG. 1.

FIG. 2 illustrates a structure of the ice making device 11 and the chip ice stocker 12. The ice making device 11 includes an auger 18 rotating spirally around a substantially vertical axis, a cylinder 19 having a cylindrical ice-making face around the auger 18, and a cooling pipe 20 wound around the cylinder 19. The cylinder 19 is made of stainless steel and has a water supply nozzle 19*a*. The water supply nozzle 19*a* is formed on a lower end portion of the cylinder 19 and is connected to a water supply tank (not shown) via a water supply pipe 23. The cooling pipe 24 for cooling water supplied into the cylinder 19 from the nozzle 19*a* constitutes a freezing circuit with a compressor and a condenser (not shown).

The ice making device 11 further includes an ice extracting die 20 having a passage 20*a* for compressing and solidifying the ice scraped by the auger 18 from the ice-making face of the cylinder 19, and an agitator 22 for agitating the ice extracted from the passage 20*a*. The ice-extracting die 20 is attached to an upper end portion of the cylinder 19 and has a center hole for supporting the auger 18. The agitator 21 is attached to an upper end portion of the auger 18 upwardly extended from the ice extracting die 20. The agitator 22 has a cone shaped face for folding ice extracted from the passage 20*a* and agitation rods 21 for agitating the ice folded at the cone shaped face of the agitator 22.

The chip ice stocker 12 is made of stainless steel and is attached to the upper end portion of the cylinder 19. The chip ice stocker 12 has a cylindrical wall 12*a* around the agitator 22 and an opening formed on the cylindrical wall 12*a*.

Figure 3:
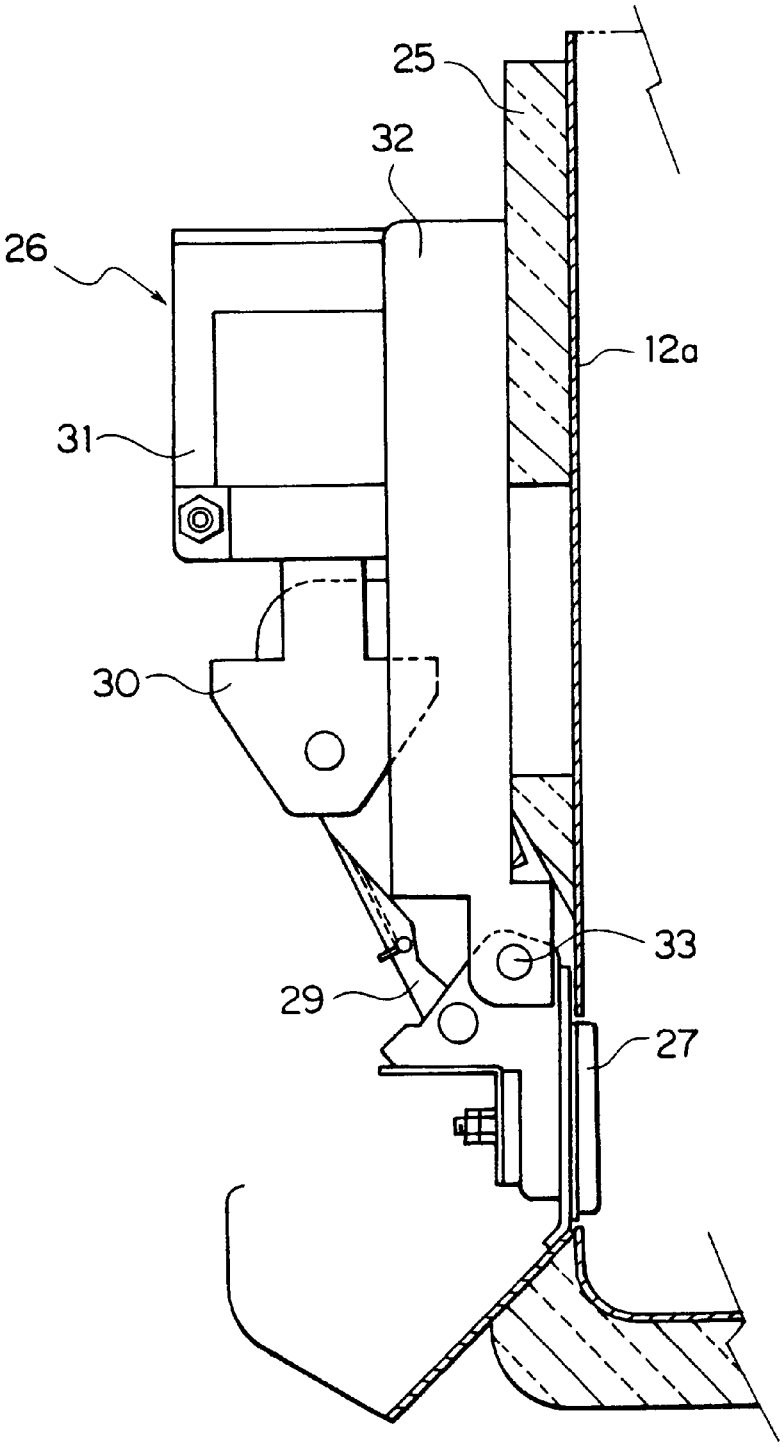
FIG. 3 is a side view showing a shutter device as shown in FIG. 2.
Figure 4:
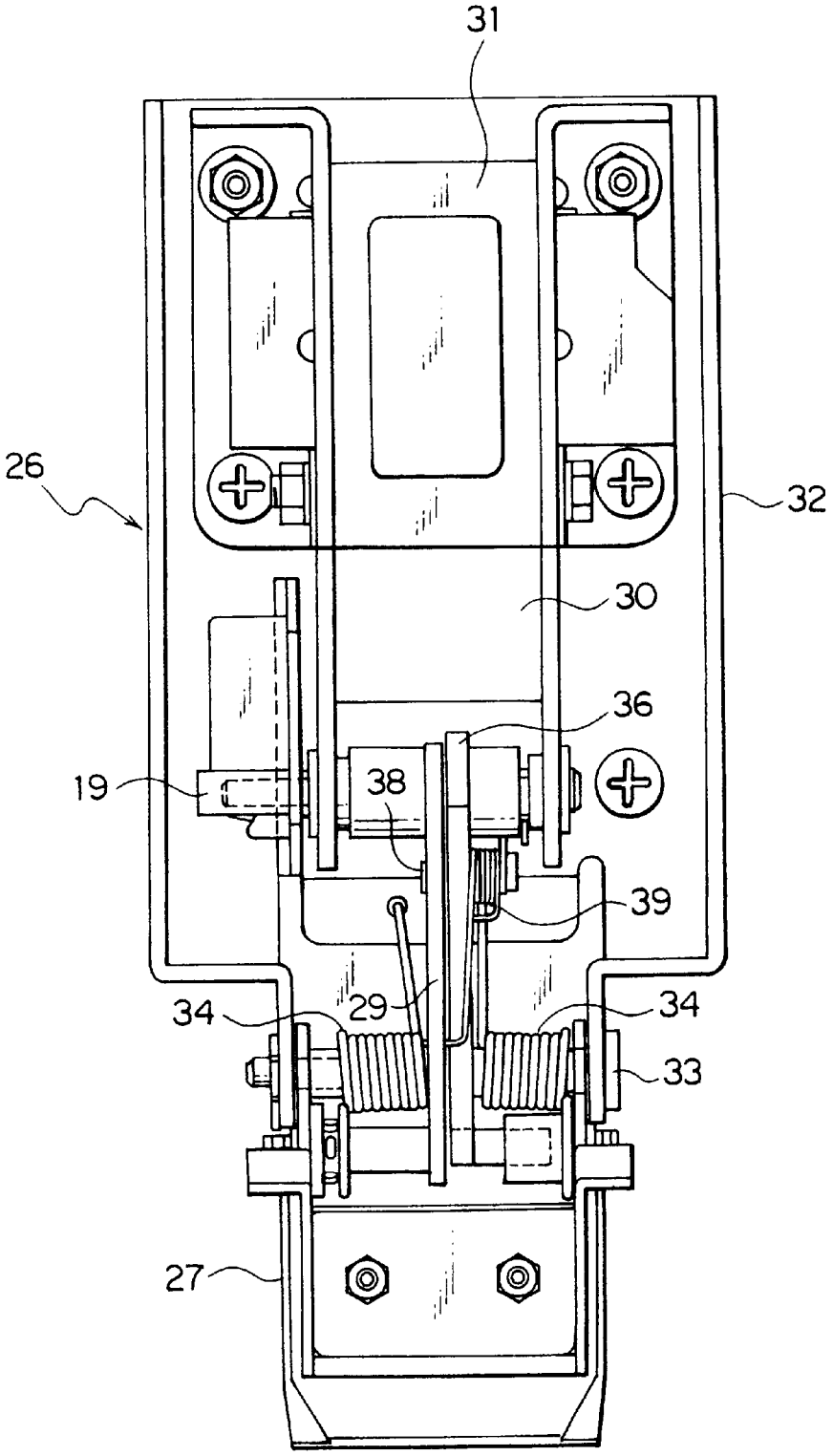
FIG. 4 is a front view showing the shutter device.

As specifically illustrated in FIGS. 3 and 4, the opening formed on the cylindrical wall 12*a* of the chip ice stocker 12 is opened and closed by an opening open/closure device 26. The opening open/closure device 26 includes a bracket 32 attached to the cylindrical wall 12*a*, a shutter 27 pivotably joined to the bracket 32 via a connecting shaft 33, shutter springs 34 for energizing the shutter 27 around the connecting shaft 33 so that the shutter 27 closes the opening, a solenoid 31 fixed on the bracket 32, a plunger 30 that is actuated at right angle to the connecting shaft 33 by the electromagnetic action of the solenoid 31, and a link 29 for joining the shutter 27 and the plunger 30.

Figure 5:
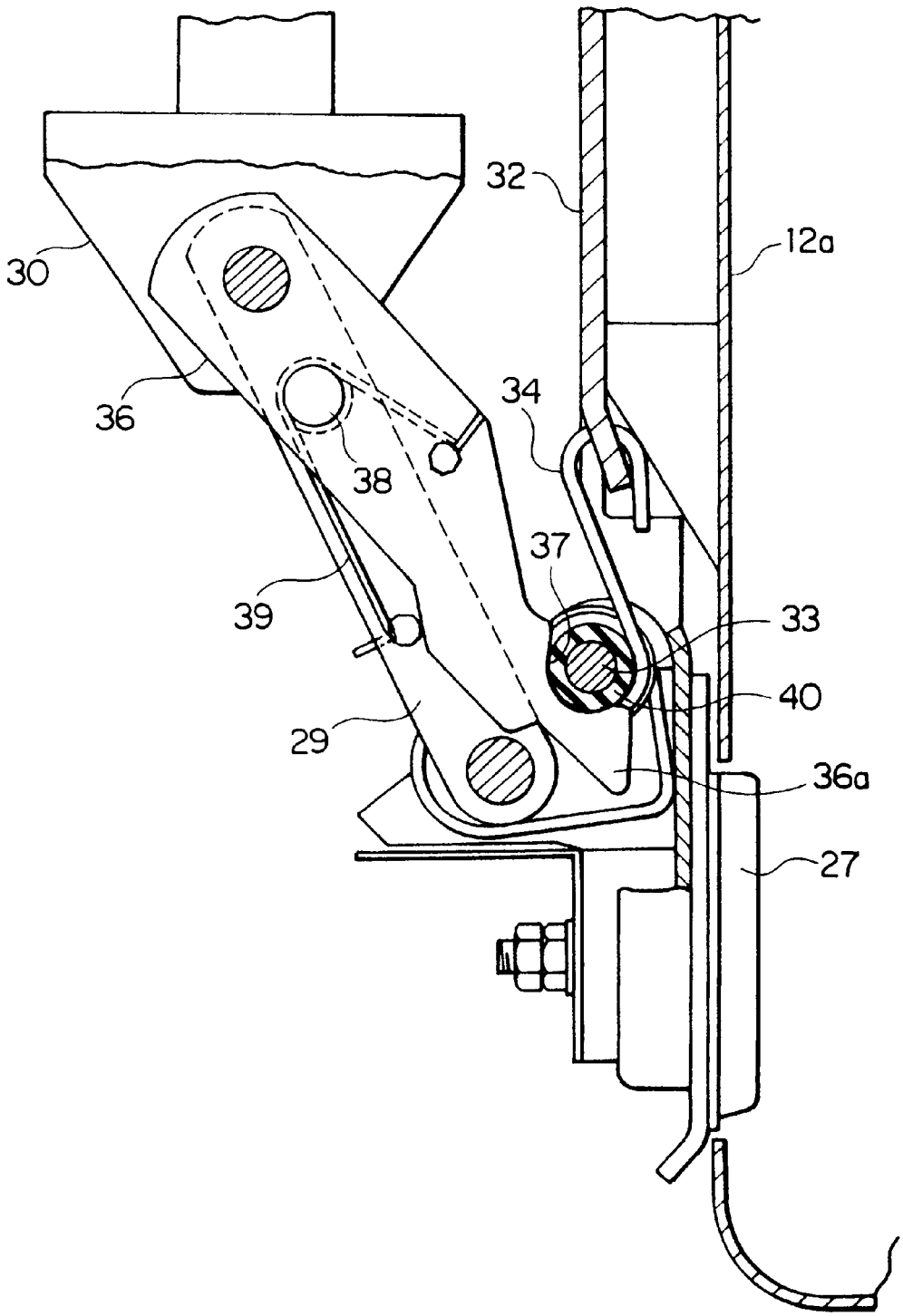
FIG. 5 is a side view showing a primary part of the shutter device.

As illustrated in FIG. 5, the opening open/closure device 26 further includes a supporting pivot 38 attached to the link 29 parallel to the connecting shaft 33, and a shutter lock arm 36 pivotably supported around the supporting pivot 38. The shutter lock arm 36 has a hollow portion 37 shaped so as to engage an outer peripheral surface of the connecting shaft33. The shutter lock arm 36 is formed from a metallic material so as stainless steel and having a surface that is subjected to tufftriding treatment.

The opening open/closure device 26 further includes shutter lock spring means 39 for locking the shutter 27 by applying spring force to the shutter lock arm 36 pivoted around the supporting pivot 38 thereby pressing the hollow portion 37 on the outer peripheral surface of the connecting shaft33.

Figure 6:
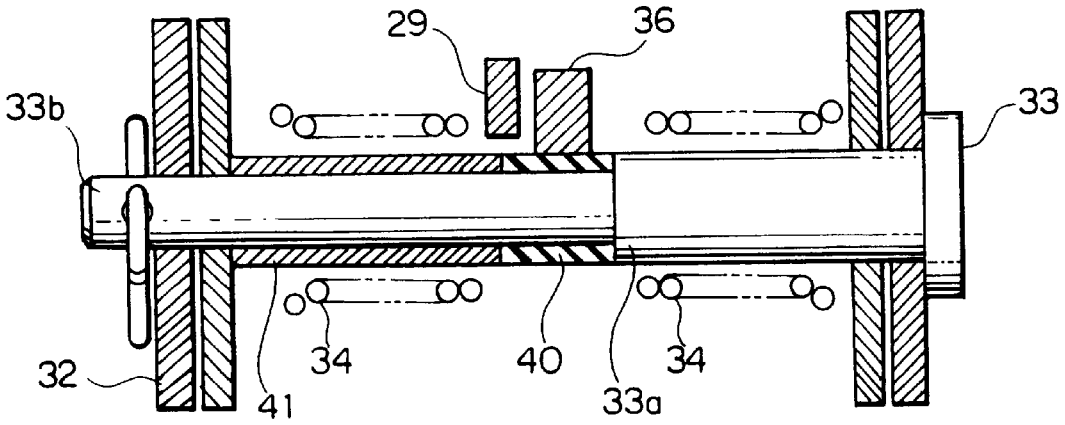
FIG. 6 is a diagram showing a structure of a connecting shaft shown FIG. 2.

As illustrated in FIG. 6, the connecting shaft 33 is provided with a sleeve 40 having an outer peripheral surface, which engages to the hollow portion 37. The sleeve 40 is formed from material, preferably fluorine resin, which is softer than the shutter lock arm 36. The sleeve 40 is positioned at a center portion of the connecting shaft 33 along the longitudinal direction of the connecting shaft 33. The connecting shaft 33 is provided with a first axis portion 33*a* having substantially the same outside diameter as that of the sleeve 40, and a second axis portion 33*b* formed at one end of the first axis portion 33*a*. The sleeve 40 is sandwiched between the first axis portion 33*a* and a pipe 41 fitted around the outer periphery of the second axis portion 33*b*.

According to one aspect of the present invention, since the sleeve 40 is made of softer material than that of the shutter lock arm 36, wearing down the hollow portion 37 that is formed on the shutter lock arm 36 can be reduced. Accordingly, the hollow portion 37 is prevented from being held in a state of being hollowed over the connecting shaft 33 because the hollow portion 37 is not greatly worn down, so that the chip ice that has been stored in the chip ice stocker 12 can be securely delivered to a user when the user desires.

Figure 7:
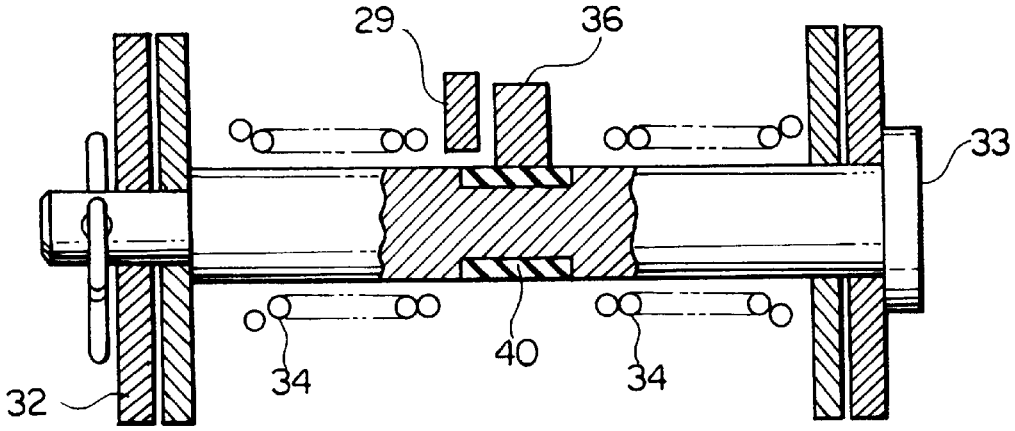
FIG. 7 is a diagram showing a primary part of a second embodiment of the present invention.

FIG. 7 illustrates a main part of a second embodiment of the present invention. According to the second embodiment of the present invention, the sleeve 40 is fitted around a ring groove 42 formed on a center portion of the outer periphery surface of the connecting shaft 33. Other arrangements than above is the same as those in the first embodiment of the present invention.

Figure 8:
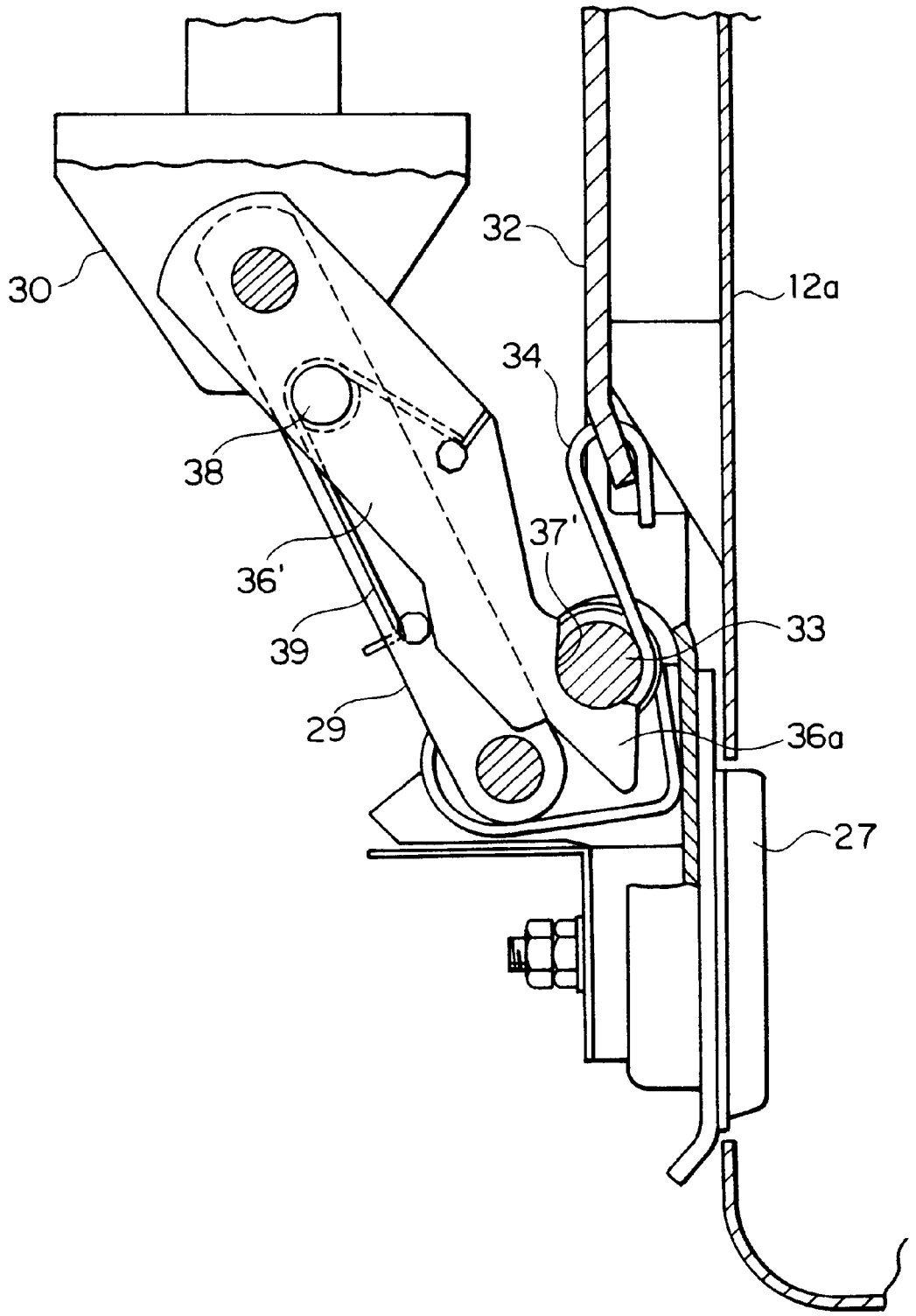
FIG. 8 is a diagram showing a primary part of a third embodiment of the present invention.

FIG. 8 illustrates a main part of a third embodiment of the present invention. In FIG. 8, a shutter lock arm 36' is made of harder material than that of a connecting shaft 33. In the third embodiment of the present invention, therefore, a hollow portion 37' that is formed at the shutter lock arm 36' is suppressed, so that the hollow portion 37' is not held in a state of being hollowed over the connecting shaft 33. As a result, chip ice that has been stored in the chip ice stocker can be securely delivered to a user when the user desires.

While the present invention has been shown in conjunction with preferred embodiment thereof, it is not so limited but is susceptible of many variations and modifications without departing from the spirit and scope of the appended claims.

What is claimed is:

1. An ice dispenser comprising:

an ice making device including an auger that rotates around a substantially vertical axis, and an agitator attached to an upper end portion of the auger;

a chip ice stocker having a cylindrical wall formed around the agitator and an opening formed on the cylindrical wall; and an opening open/closure device 26 including a bracket 32 attached to the cylindrical wall 12*a*, a shutter 27 pivotably joined to the bracket via a connecting shaft 33, shutter springs 34 for energizing the shutter around the connecting shaft so that the shutter closes the opening, a solenoid 31 fixed on the bracket, a plunger 30 that is actuated at right angle to the connecting shaft by the electromagnetic action of the solenoid, a link 29 for joining the shutter and the plunger, a supporting pivot 38 attached to the link 29 parallel to the connecting shaft, a shutter lock arm 36 pivotably supported around the supporting pivot and having a hollow portion 37 shaped so as to engage an outer peripheral surface of the connecting shaft 33, and shutter lock spring means 39 for locking the shutter by applying spring force to the shutter lock arm 36 pivoted around the supporting pivot 38 thereby pressing the hollow portion on the outer peripheral surface of the connecting shaft;

wherein the connecting shaft 33 is provided with a sleeve 40 formed from material which is softer than the shutter lock arm 36, and having an outer periphery surface which engages to the hollow portion.

2. An ice dispenser as claimed in claim 1, wherein the shutter lock arm is formed from a metallic material.

3. An ice dispenser as claimed in claim 1, wherein the shutter lock arm has a surface that is subjected to tufftriding treatment.

4. An ice dispenser as claimed in claim 1, wherein the sleeve is positioned at a center portion of the connecting shaft along the longitudinal direction of the connecting shaft.

5. An ice dispenser as claimed in claim 4, wherein the connecting shaft includes a first axis portion having substantially the same outside diameter as that of the sleeve, and a second axis portion formed at one end of the first axis portion.

6. An ice dispenser as claimed in claim 5, wherein the sleeve is sandwiched between the first axis portion and a pipe fitted around the outer periphery of the second axis portion.

7. An ice dispenser as claimed in claim 1, wherein the sleeve is formed from fluorine resin.

8. An ice dispenser comprising:

an ice making device including an auger that rotates around a substantially vertical axis, and an agitator attached to an upper end portion of the auger;

a chip ice stocker having a cylindrical wall formed around the agitator and an opening formed on the cylindrical wall; and an opening open/closure device including a bracket attached to the cylindrical wall, a shutter pivotably joined to the bracket via a connecting shaft, shutter springs for energizing the shutter around the connecting shaft so that the shutter closes the opening, a solenoid fixed on the bracket, a plunger that is actuated at right angle to the connecting shaft by the electromagnetic action of the solenoid, a link for joining the shutter and the plunger, a supporting pivot attached to the link parallel to the connecting shaft, a shutter lock arm pivotably supported around the supporting pivot and having a hollow portion shaped so as to engage an outer peripheral surface of the connecting shaft, and shutter lock spring means for locking the shutter by applying spring force to the shutter lock arm pivoted around the supporting pivot thereby pressing the hollow portion on the outer peripheral surface of the connecting shaft;

wherein the shutter lock arm is formed from material which is harder than the connecting shaft.

9. An ice dispenser as claimed in claim 2, wherein the sleeve is formed from fluorine resin.

10. An ice dispenser as claimed in claim 3, wherein the sleeve is formed from fluorine resin.

11. An ice dispenser as claimed in claim 4, wherein the sleeve is formed from fluorine resin.

12. An ice dispenser as claimed in claim 5, wherein the sleeve is formed from fluorine resin.

13. An ice dispenser as claimed in claim 6, wherein the sleeve is formed from fluorine resin.

* * * * *